US011164508B2

(12) United States Patent
Yang et al.

(10) Patent No.: US 11,164,508 B2
(45) Date of Patent: Nov. 2, 2021

(54) ELECTRONIC DEVICE

(71) Applicant: ASUSTeK COMPUTER INC., Taipei (TW)

(72) Inventors: Chih-Hsien Yang, Taipei (TW); Chih-Chuan Lin, Taipei (TW); Kou-Liang Lin, Taipei (TW); Chi-Liang Tsai, Taipei (TW); I-Hsi Wu, Taipei (TW); Yu-Hao Hu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/869,674

(22) Filed: May 8, 2020

(65) Prior Publication Data

US 2020/0365072 A1 Nov. 19, 2020

Related U.S. Application Data

(60) Provisional application No. 62/848,643, filed on May 16, 2019.

(30) Foreign Application Priority Data

Jan. 3, 2020 (CN) ..... 202010004285.1

(51) Int. Cl.
*G09G 3/20* (2006.01)
*G09G 3/34* (2006.01)

(52) U.S. Cl.
CPC ..... *G09G 3/2092* (2013.01); *G09G 3/20* (2013.01); *G09G 3/34* (2013.01); *G09G 3/3406* (2013.01);
(Continued)

(58) Field of Classification Search
CPC ..... G09G 3/3406; G09G 3/34; G09G 3/20; G09G 3/2092; G09G 2320/064; G09G 2320/0653; G09G 2360/144
See application file for complete search history.

(56) References Cited

U.S. PATENT DOCUMENTS 8,269,511 B2 * 9/2012 Jordan ..... G06F 3/041661 324/679
9,335,869 B2 * 5/2016 Mattice ..... G07F 17/3209
(Continued)

FOREIGN PATENT DOCUMENTS

CN 106652922 A 5/2017
WO 2013184375 A1 12/2013

*Primary Examiner* — Vijay Shankar
(74) *Attorney, Agent, or Firm* — McClure, Qualey & Rodack, LLP

(57) ABSTRACT

An electronic device is disclosed. The electronic device includes a display unit, a light sensor, and a processor. The display unit has a brightness value. The light sensor senses an ambient light to generate a light intensity signal. The processor is coupled to the display unit and the light sensor and accesses a program instruction from a memory to perform the following steps: continuously receiving the light intensity signal from the light sensor; smoothing a plurality of light intensity signals to generate a plurality of smoothing signals; and maintaining the brightness value of the display unit for a preset time period and then determining whether to adjust the brightness value when a difference generated by subtracting a previous smoothing signal of a target smoothing signal of the smoothing signals from the target smoothing signal is less than the first threshold or greater than the second threshold.

8 Claims, 6 Drawing Sheets

(52) U.S. Cl.
CPC . *G09G 2320/064* (2013.01); *G09G 2360/144* (2013.01)

(56) References Cited

U.S. PATENT DOCUMENTS

| | | | | |
|---|---|---|---|---|
| 9,367,235 | B2 * | 6/2016 | Westerman | G06F 3/017 |
| 2008/0278455 | A1 * | 11/2008 | Atkins | G06F 3/0488 345/173 |
| 2012/0274583 | A1 * | 11/2012 | Haggerty | G06F 3/0488 345/173 |

* cited by examiner

ELECTRONIC DEVICE

CROSS-REFERENCE TO RELATED APPLICATION

This application claims the priority benefit of U.S. Provisional Application Ser. No. 62/848,643, filed on May 16, 2019 and China application serial No. 202010004285.1, filed on Jan. 3, 2020. The entirety of the above-mentioned patent application is hereby incorporated by reference herein and made a part of the specification.

BACKGROUND OF THE INVENTION

Field of the Invention

The disclosure relates to an electronic device.

Description of the Related Art

Consumer electronic devices such as smartphones are operated by users under various environments with different brightness. Therefore, an electronic device needs to adjust brightness of its display with a reading that corresponds to a brightness of an ambient light by using a light sensor. However, an operation manner of a user, for example, in a landscape mode, affects the detection of a light source in the environment by the light sensor. As a result, brightness of the electronic device is incorrectly adjusted, resulting in poor user experience.

BRIEF SUMMARY OF THE INVENTION

According to an aspect, an electronic device is provided. The electronic device includes: a display unit, comprising a brightness value; a light sensor, configured to sense ambient light and generate a light intensity signal; and a processor, coupled to the display unit and the light sensor, wherein the processor is configured to access a program instruction from a storage element, to perform the following steps: continuously receiving the light intensity signal from the light sensor; smoothing the light intensity signals received from the light sensor in a plurality of time frames, to generate a plurality of smoothing signals; determining whether a difference generated by subtracting a previous smoothing signal from a target smoothing signal of the plurality of smoothing signals the is less than a first threshold or greater than a second threshold; and maintaining the brightness value of the display unit for a preset time period and then determining whether to adjust the brightness value when the difference is less than the first threshold or greater than the second threshold.

For the electronic device and the method for adjusting brightness of the electronic device provided in the disclosure, values of a light intensity signal in the plurality of time frames are processed, and then the values of the light intensity signal are compared with a threshold, to correctly determine a change in a light source in an environment in which the electronic device is located and further accurately adjust brightness of the display unit.

BRIEF DESCRIPTION OF THE DRAWINGS

In order to make the stated and other objectives, features, advantages, and embodiments of the disclosure more comprehensible, the description is provided as follows with reference to the accompanying drawings.

DETAILED DESCRIPTION OF THE EMBODIMENTS

Any element in the scope of the patent should not be interpreted as a means function unless it clearly states that "the device is configured to" perform a specific function or "steps are used to" perform a specific function.

As used herein, "coupled" or "connected" may refer to that two or more elements are in direct physical or electrical contact with each other or in indirect physical or electrical contact with each other or two or more elements operate or act with each other.

Figure 1:
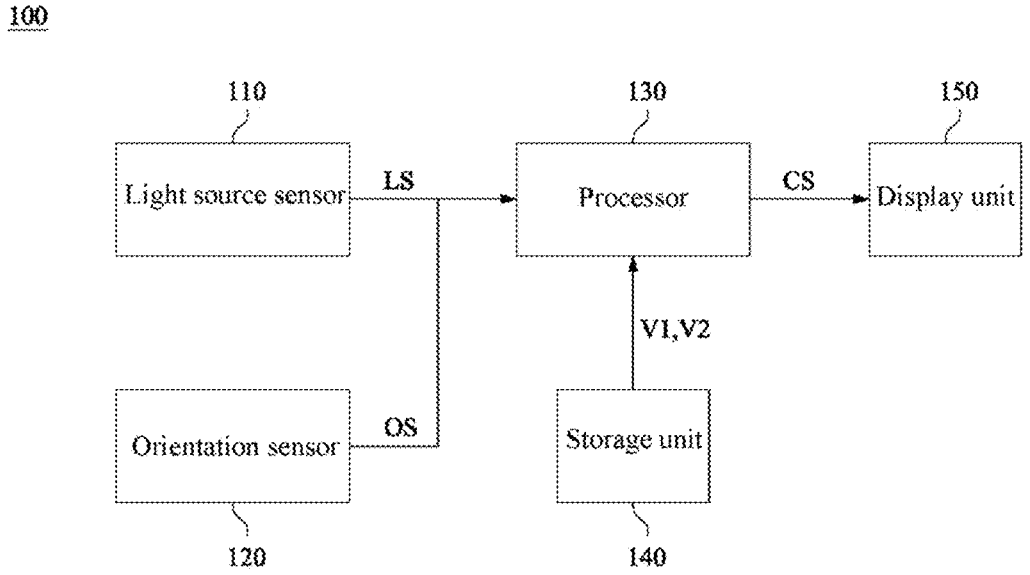
FIG. 1 is a schematic diagram of an electronic device according to an embodiment of the disclosure.

Refer to FIG. 1 of the disclosure. FIG. 1 is a schematic diagram of an electronic device 100 according to an embodiment of the disclosure. In an embodiment, the electronic device 100 has a function of adjusting display brightness. In an embodiment, the electronic device 100 is a smartphone, a smartwatch, a tablet computer, a laptop computer, or another electronic device with a screen.

As shown in FIG. 1, the electronic device 100 includes a light sensor 110, an orientation sensor 120, a processor 130, a storage element 140, and a display unit 150. For a connection relationship, the processor 130 is electronically connected with the light sensor 110, the orientation sensor 120, the storage element 140, and the display unit 150.

In an embodiment, the light sensor 110 senses an ambient light to generate a light intensity signal LS. The orientation sensor 120 senses an orientation of the display unit 150 to output an orientation signal OS to the processor 130. The processor 130 calculates a value of the light intensity signal LS according to the orientation signal OS, to generate a control signal CS according to the calculated value. The processor 130 adjusts brightness of the display unit 150 by the control signal CS. The storage element 140 stores a first threshold V1 and a second threshold V2 that are used as a basis of generating the control signal CS and a correspondence table, function, algorithm or the like between the value of the light intensity signal LS and the display unit 150.

In an embodiment, the light sensor 110 is a photodiode, a phototransistor, a photo-resistor, a complementary metal-oxide-semiconductor (CMOS) or a charge-coupled device (CCD) that senses light intensity. In an embodiment, the orientation sensor 120 is an acceleration sensor configured to generate a corresponding displacement and speed information when the electronic device 100 moves. In an embodiment, the orientation sensor 120 is a gyroscope sensor configured to generate a corresponding angular acceleration when the electronic device 100 moves. In an embodiment, the orientation sensor 120 is an apparatus that senses whether the display unit 150 is in a landscape mode or a portrait mode. In an embodiment, the processor 130 is implemented by one or more processors such as a central processing unit (CPU), a microprocessor, or a processing circuit with the functions of the disclosure. In an embodiment, the display unit 150 is a liquid crystal displayer (LCD), an organic light emitting diode (OLED) displayer, a thin-film transistor LCD (TFT LCD), a flexible display or a 3D displayer. The storage element 140 includes one or more memory unit. Each of the memory units includes a computer-readable storage medium such as a hard disk, an optical disc or a database accessible from a network or any storage medium having the same function that is conceivable by a person skilled in the art. The storage element 140 is an internal or external memory of the electronic device 100, includes a volatile or non-volatile memory, and stores at least one program instruction. In this embodiment, the processor 130 accesses and executes the at least one program instruction from the storage element 140, to further perform a brightness control method defined by the at least one program instruction. To facilitate understanding, the brightness control method defined by the at least one program instruction is described in detail in the following paragraphs.

Figure 2:
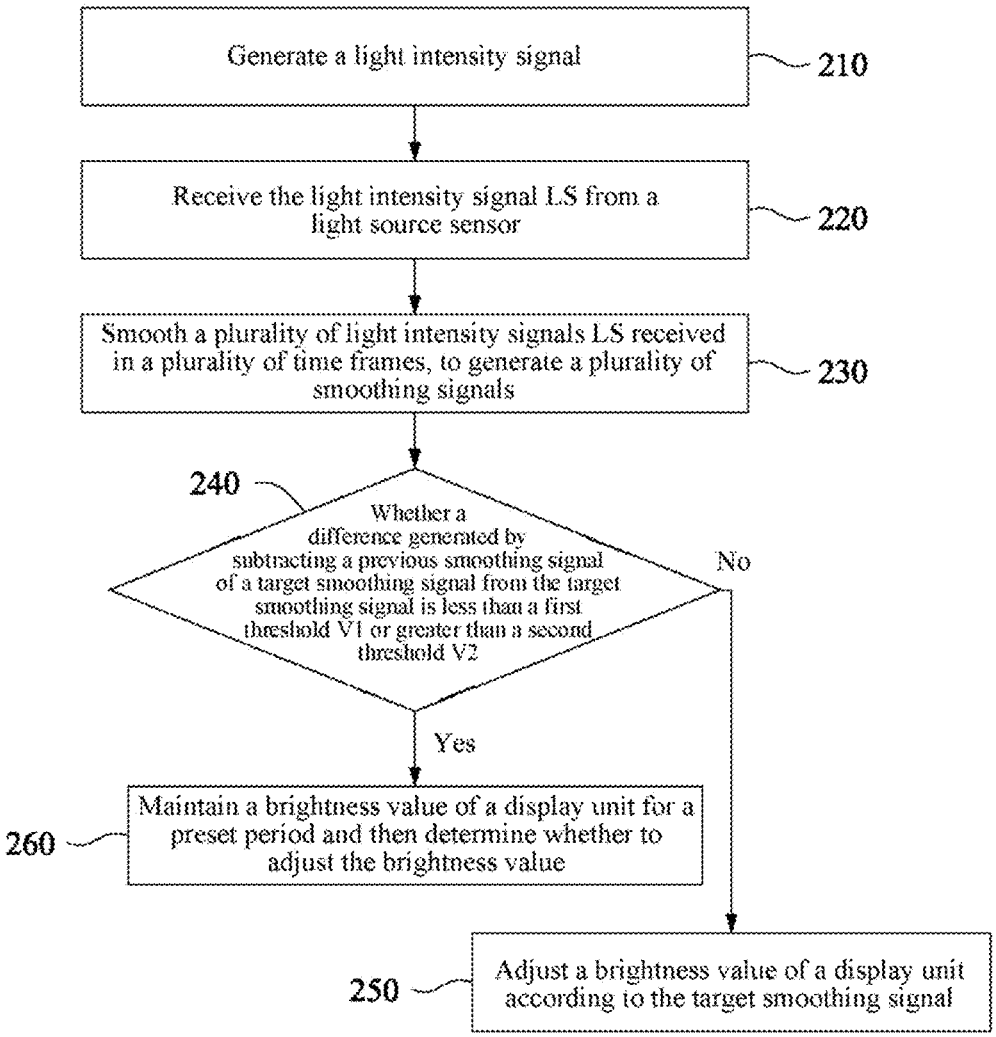
FIG. 2 is a flowchart of a brightness control method of an electronic device according to an embodiment of the disclosure.
Figure 3:
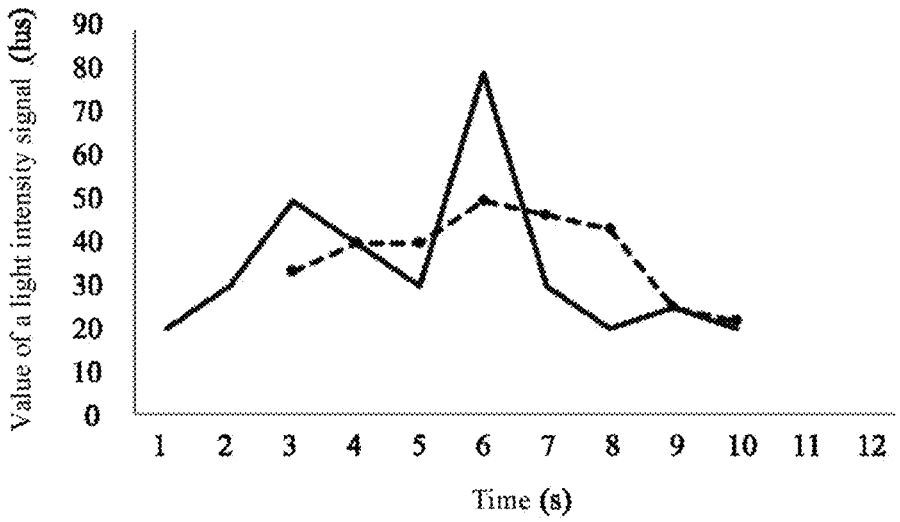
FIG. 3 is a schematic diagram of time and a value of a light intensity signal according to an embodiment of the disclosure.

Refer to FIG. 1, FIG. 2, and FIG. 3 together. FIG. 2 is a flowchart of a brightness control method 200 of an electronic device according to an embodiment of the disclosure. FIG. 3 is a schematic diagram of time and a value of a light intensity signal LS according to an embodiment of the disclosure. In some embodiments, the brightness control method 200 is applied to an electronic device having a structure that is the same as or similar to the structure of the electronic device 100 shown in FIG. 1. As shown in FIG. 2, the brightness control method 200 of the electronic device includes steps 210, 220, 230, 240, 250, and 260. The following describes some steps of the brightness control method 200 of the electronic device with reference to FIG. 1 and FIG. 3.

In step 210, a light sensor 110 generates a light intensity signal LS according to an ambient light in which the electronic device 100 is located. In some embodiments, the light sensor 110 generates one light intensity signal LS corresponding to light intensity of the ambient light every second, and a value of the light intensity signal LS is 20 lux, 100 lux or the like. In some embodiments, the magnitude of voltage or current for the light intensity LS is used to represent the value of the light intensity. However, the disclosure is not limited thereto. The value of the light intensity signal LS, the type of the light intensity signal LS, the frequency of capturing the intensity of ambient light, and the like are different depending on the environment and requirements. A person skilled in the art designs a required light intensity signal LS as required without departing from the spirit and scope of the disclosure.

As shown in FIG. 3, the solid line in the figure includes the values of the light intensity signals LS generated by the light sensor 110 in a time period. Specifically, in an embodiment, the value of the light intensity signal LS is 20 at the first second, 30 at the second second, 50 at the third second, 40 at the fourth second, 30 at the fifth second, 80 at the sixth second, 30 at the seventh second, 20 at the eighth second, and 25 at the ninth second. The above values are examples to facilitate understanding of the disclosure, but do not limit the embodiments of the disclosure. In an embodiment, the value of the light intensity signal LS is generated at the frequency of once every 0.5 seconds. In an embodiment, and the value of the light intensity signal LS is greater than 80 or less than 20.

Next, in step 220, the processor 130 accesses a program instruction from the storage element 140 to continuously receive the light intensity signal LS from the light sensor 110.

In step 230, the processor 130 accesses the program instruction from the storage element 140 to smooth a plurality of light intensity signals LS received from the light sensor in a plurality of time frames, to generate a plurality of smoothing signals. In some embodiments, the processor 130 defines the length of the time frame, and smooths the values of the plurality of light intensity signals LS received in the time frames, to output the smoothing signals. In some embodiments, a smoothing method includes Laplace smoothing, exponential smoothing, kernel smoothing, moving average, Ramer-Douglas-Peucker algorithm or smoothing spline. In some embodiments, the light intensity signal LS is smoothed by using a Butterworth filter, a Kalman filter, a Chebyshev filter, an elliptic filter, a Kolmogorov-Zurbenko (K-Z) filter, a Savizky-Golay (S-G) filter or a low-pass filter.

In the embodiment shown in FIG. 3, the first time frame is form the first second to the third second and the smoothing method is moving average. The processor 130 receives light intensity signals LS at the first second, the second second, and the third second (the values of the light intensity signals LS at the first second to the third second are 20, 30, and 50 respectively.), and averages the light intensity signals LS at the first second to the third second, to obtain 33 that is a value of a smoothing signal corresponding to the first time frame. Similarly, in a second time frame, the processor 130 further receives the value of the light intensity signal LS at the fourth second, and then averages the values of the light intensity signals LS at the second second, the third second and the fourth second (the values of the light intensity signals LS at the second second to the fourth second are 30, 50, and 40 respectively), to obtain 40 that is a value of a smoothing signal corresponding to the second time frame. Similarly, in a third time frame, the value of the light intensity signal LS at the fifth second is input into the processor 130, and the values of the light intensity signals LS at the third second, the fourth second and the fifth second (the values of the light intensity signals LS at the third second to the fifth second are 50, 40, and 30 respectively) are averaged, to obtain 40 that is a value of a smoothing signal corresponding to the third time frame. In addition, a case that the foregoing time frame is 3 seconds is used as an example. However, the disclosure is not limited thereto.

It should be noted that, the method in which the processor 130 is configured to smooth the value of the light intensity signal LS can be the method in which a person skilled in the art applies the method disclosed in the disclosure. In the foregoing embodiments, using the moving average method to average the values of the plurality of light intensity signals LS received in each time frame. In different embodiments, a median, a first quartile, a third quartile or the like of the value of the plurality of light intensity signals LS received in each time frame is obtained. The disclosure is not limited to the embodiments described above. In some embodiments, the processor 130 determines whether the display unit 150 is in a landscape mode according to the orientation signal OS. When the display unit 150 is in the landscape mode, smoothing processing is performed on the light intensity signal LS. When the display unit 150 is not in the landscape mode, the smoothing processing is not performed on the light intensity signal LS. In other words, the processor 130 determines, whether to calculate the value of the light intensity signal LS according to the orientation signal OS. The foregoing embodiments are examples described to facilitate understanding of the disclosure, but do not limit the embodiments of the disclosure. In other embodiments, regardless of whether the display unit 150 is in the landscape mode, the processor 130 performs the smoothing processing on the light intensity signal LS.

In addition, in an embodiment, each light intensity signal LS and the smoothing signal both have corresponding brightness of the display unit 150. A correspondence table between the light intensity signal LS and the brightness of the display unit 150 and a correspondence table between a smoothing signal storage element and the brightness of the display unit 150 are both stored in the storage element 140.

In some embodiments, the processor 130 generates a control signal CS according to the light intensity signal LS to adjust a brightness value of the display unit 150 (in an embodiment, the brightness value of the display unit 150 is adjusted to a display brightness value corresponding to a current light intensity signal LS.). In other words, the processor 130 does not further calculate or does not smooth the value of the light intensity signal LS. Specifically, in an embodiment, the processor 130 directly adjusts the brightness of the display unit 150 according to a correspondence function, table or algorithm between the value of the light intensity signal LS and the brightness of the display unit 150.

Next, in step 240, the processor 130 accesses the program instruction from the storage element 140 to determine whether a difference generated by subtracting a previous smoothing signal from the target smoothing signal of the smoothing signals is less than a first threshold V1 or greater than a second threshold V2. When the difference is not less than the first threshold V1 or the difference is not greater than the second threshold V2, step 250 is performed. When the difference is less than the first threshold V1 or greater than the second threshold V2, step 260 is performed.

In step 250, a brightness value of the display unit 150 is adjusted according to the target smoothing signal. In some embodiments, the brightness value of the display unit 150 is adjusted to a display brightness value corresponding to the target smoothing signal.

Correspondingly, in step 260, a brightness value of the display unit 150 is maintained for a preset time period and then it is determined whether to adjust the brightness value. In some embodiments, the preset time period includes a first preset time period or a second preset time period. Specifically, when the difference is less than the first threshold V1, the brightness of the display unit 150 is maintained for the first preset time period. Correspondingly, when the difference is greater than the second threshold V2, the brightness of the display unit 150 is maintained for the second preset time period.

Figure 4A:
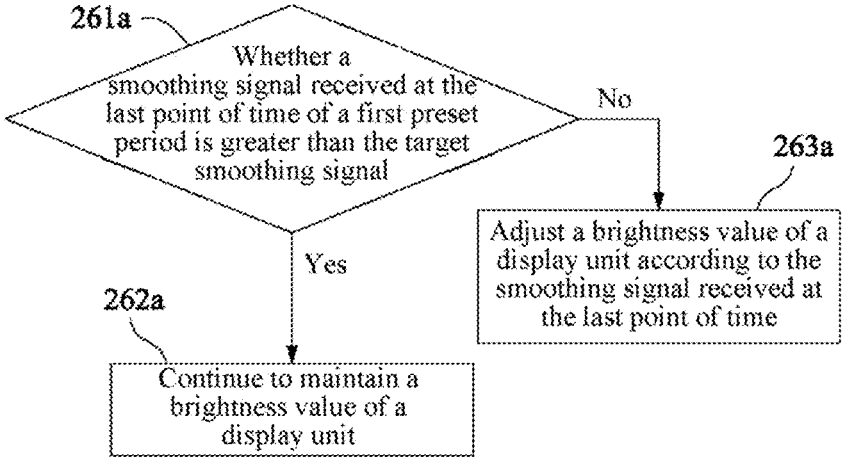
FIG. 4A and FIG. 4B are detailed flowcharts of the brightness control method of the electronic device according to the embodiment shown in FIG. 2.
Figure 5A:
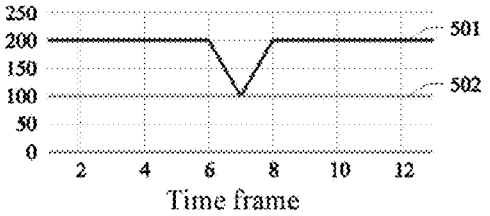
FIG. 5A to FIG. 5C are schematic diagrams of smoothing signals and brightness of a display unit according to different embodiments of the disclosure.
Figure 5B:
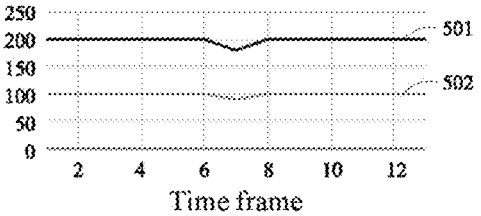
Figure 5C:
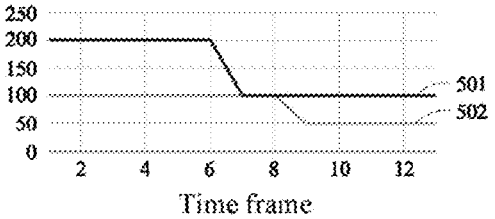

In order to describe steps of the brightness control method 200 of the electronic device in detail, related details are described with reference to the embodiments shown in FIG. 4A and FIG. 5A to FIG. 5C. FIG. 4A is a detailed flowchart of step 260 of the brightness control method 200 of the electronic device according to the embodiment shown in FIG. 2. FIG. 5A to FIG. 5C are schematic diagrams of a smoothing signal 501 and brightness 502 of a display unit according to different embodiments of the disclosure. In some embodiment, the unit of the smoothing signal 501 is lux, and the unit of the brightness 502 of the display unit is nit.

Specifically, in the embodiments shown in FIG. 5A to FIG. 5C, the first threshold V1 is −30 30, and the first preset time period includes two time frames. Refer to FIG. 5A. As shown in FIG. 5A, in this embodiment, the smoothing signal 501 is maintained at 200 lux from a time frame 1 to a time frame 6. In a time frame 7, the smoothing signal 501 drops from 200 lux to 100 lux. That is, the value of the smoothing signal in the time frame 6 is subtracted from the value of the smoothing signal in the time frame 7 (used as the target smoothing signal) to obtain a difference of −100. According to the foregoing step 240, the processor 130 determines that the difference (−100) is less than the first threshold V1 (−30), and performs step 260 to maintain the brightness of the display unit 150 for the first preset time period (two time frames). Specifically, the brightness of the display unit 150 is maintained from the time frame 7 to the time frame 8.

Subsequently, as shown in FIG. 4A, in step 261*a*, the processor 130 determines whether the smoothing signal 501 that received at the last time point of the first preset time period is greater than the target smoothing signal. In an embodiment, the smoothing signal 501 received at the last time point (the time frame 8) of the first preset time period is 200 lux and the smoothing signal (200 lux) received in the time frame 8 is greater than the smoothing signal (100 lux) received in the time frame 7, thus the processor 130 performs step 262*a*.

In step 262*a*, the processor 130 continues to maintain a brightness value of the display unit 150. In some embodiments, the processor 130 continues to maintain the brightness value of the display unit 150 until the smoothing signal 501 changes again, and performs the foregoing step 240 and the subsequent steps when the smoothing signal 501 changes.

In addition, in this embodiment shown in FIG. 5A, when the smoothing signal suddenly drops in the time frame 7 and the smoothing signal returns to the original value in subsequent time frames, it is considered that the light sensor 110 of the electronic device 100 is blocking by a finger. In this case, the ambient light of the environment where the electronic device 100 is located is not changed greatly. Therefore, the brightness control method disclosed in this embodiment of the disclosure prevents the processor from adjusting the brightness of the display unit 150 by incorrectly determining the change of the ambient light and causing poor user experience.

Subsequently, refer to FIG. 5B, in the embodiment that the smoothing signal 501 drops from 200 lux to 175 lux in the time frame 7. The value of the smoothing signal in the time frame 6 is subtracted from the value of the smoothing signal in the time frame 7 (as the target smoothing signal) to obtain a difference of −25. In this case, according to the foregoing step 240, the processor 130 determines that the difference (−25) is greater than the first threshold V1 (−30), and the processor 130 performs step 250 to adjust the brightness value of the display unit 150 according to the value of the smoothing signal in the time frame 7. In this embodiment, the brightness of the display unit 150 is adjusted from 100 nit to 87.5 nit.

Subsequently, refer to FIG. 5C, the smoothing signals 501 in the time frame 8 and the subsequent time frames are the same as that in the time frame 7. In other words, after the processor 130 performs step 260 where the brightness of the display unit 150 remain unchanged in the time frame 7 and the time frame 8, step 261*a* is performed. When the processor 130 determines that the smoothing signal (100) received in the time frame 8 is the same as the smoothing signal received in the time frame 7, step 263*a* is performed.

In step 263*a*, the processor 130 adjusts a brightness value of the display unit 150 according to the smoothing signal received at the last time point (the time frame 8). Specifically, as shown in FIG. 5C, in an embodiment, the processor 130 adjusts the brightness value of the display unit 150 from 100 nit to 50 nit.

Furthermore, in the embodiment shown in FIG. 5C, the electronic device 100 is considered to be taken into a relatively dark environment where the smoothing signals received in the subsequent time frames after the time frame 7 are the same as that received in the time frame 7. The electronic device provided in the disclosure stably and gradually adjusts the brightness of the display unit 150 to provide a well user experience.

Figure 6A:
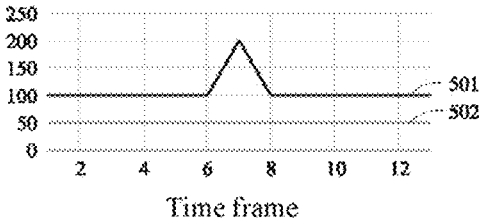
FIG. 6A to FIG. 6C are schematic diagrams of light intensity signals and brightness of a display unit according to different embodiments of the disclosure.
Figure 6B:
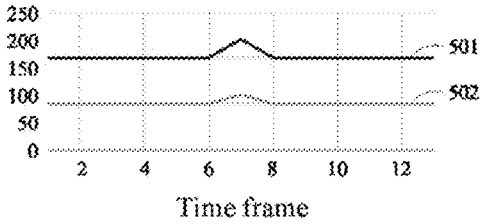
Figure 6C:
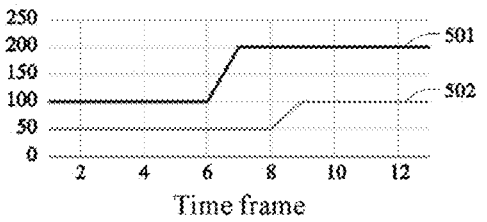

Refer to the embodiments shown in FIG. 4B and FIG. 6A to FIG. 6C together to describe related details of the brightness control method 200 of the electronic device. FIG. 4A is a detailed flowchart of step 260 of the brightness control method 200 of the electronic device according to the embodiment shown in FIG. 2. FIG. 6A to FIG. 6C are schematic diagrams of a smoothing signal 501 and brightness 502 of a display unit 150 according to different embodiments of the disclosure.

Specifically, in the embodiments shown in FIG. 6A to FIG. 6C, the second threshold V2 is set to 30, and the second preset time period includes two time frames. Refer to FIG. 6A, in an embodiment, the smoothing signal 501 is maintained at 100 lux from the time frame 1 to the time frame 6. However, in the time frame 7, the smoothing signal 501 rises from 100 lux to 200 lux. The value of the smoothing signal in the time frame 6 is subtracted from the value of the smoothing signal in the time frame 7 (as the target smoothing signal) to obtain a difference of 100. In this case, according to the foregoing step 240, the processor 130 determines that the difference (100) is greater than the second threshold V2 (30), and the processor 130 performs step 260 to maintain the brightness of the display unit 150 at the second preset time period with two time frames. Specifically, the brightness of the display unit 150 is maintained unchanged in the time frame 7 and the time frame 8.

Figure 4B:
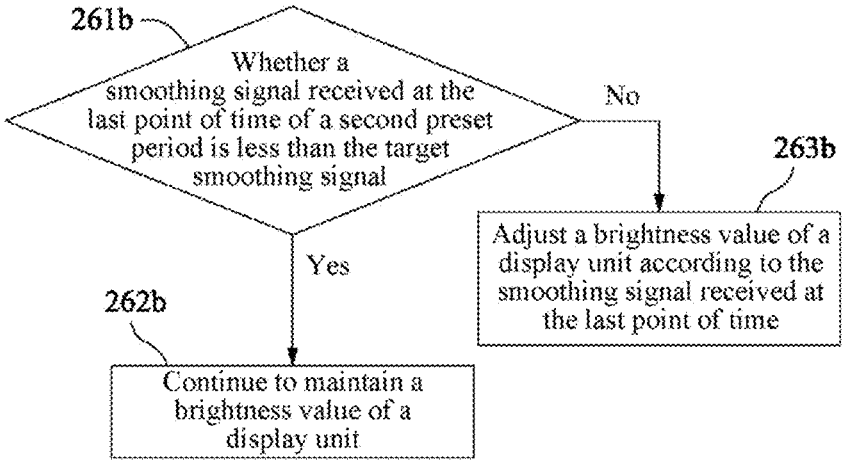

Subsequently, as shown in FIG. 4B, in step 261*b*, the processor 130 determines whether the smoothing signal 501 received at the last time point of the second preset time period is less than the target smoothing signal. In an embodiment, the smoothing signal 501 received at the last time point (the time frame 8) of the second preset time period is 100 lux and the smoothing signal (100 lux) received in the time frame 8 is less than the smoothing signal (200 lux) received in the time frame 7, so the processor 130 performs step 262*a*.

In step 262*b*, the processor 130 continues to maintain a brightness value of the display unit 150. In some embodiments, the processor 130 continues to maintain the brightness value of the display unit 150 until the smoothing signal 501 changes again, and performs the foregoing step 240 and subsequent steps when the smoothing signal 501 changes.

Subsequently, refer to FIG. 6B. Different from the embodiment in FIG. 6A, the value of the smoothing signal in the time frame 6 is subtracted from the value of the smoothing signal in the time frame 7 (used as the target smoothing signal) to obtain a difference of 25. In this case, according to the foregoing step 240, the processor 130 determines that the difference (20) is less than the second threshold V2 (30), and the processor 130 performs step 250 to adjust the brightness value of the display unit 150 according to the value of the smoothing signal in the time frame 7. Specifically, in an embodiment, the brightness of the display unit 150 is adjusted from 100 nit to 112.5 nit.

Subsequently, refer to FIG. 6C, the smoothing signals 501 in the time frame 8 and subsequent time frames are the same as that in the time frame 7. In other words, after the processor 130 performs step 260 to maintain the brightness of the display unit 150 unchanged in the time frame 7 and the time frame 8, step 261*b* is performed. It is determined that the smoothing signal (200) received in the time frame 8 is the same as the smoothing signal received in the time frame 7, and step 263*b* is performed.

In step 263*b*, the processor 130 adjusts a brightness value of the display unit 150 according to the smoothing signal received at the last time point (the time frame 8). Specifically, as shown in FIG. 6C, in an embodiment, the processor 130 adjusts the brightness value of the display unit 150 from 50 nit to 100 nit.

As the embodiment shown in FIG. 6C, the smoothing signals received in the subsequent time frames after the time frame 7 are the same as the smoothing signals received in the time frame 7 because the electronic device 100 is taken into a relatively bright environment. The electronic device provided in the disclosure stably and gradually adjusts the brightness of the display unit 150 to provide well user experience.

It should be noted that, the first threshold V1 and the second threshold V2 can be different according to the manner in which a person skilled in the art applies the method disclosed in the disclosure. The disclosure is not limited to the embodiments.

A plurality of steps of the foregoing brightness control method 200 of the electronic device is only an example, and an order of performing the steps is not limited to the order in the examples. Various operations under the brightness control method 200 of the electronic device can be appropriately added, replaced, omitted or performed in a different order without departing from the operation mode and scope of the embodiments of the disclosure.

In conclusion, for the electronic device and the method for adjusting brightness of the electronic device provided in the disclosure, a change in a value of a calculated light intensity signal is compared with a threshold related to an amount of decline and a threshold related to an amount of rise, to correctly determine a change in a light source of an environment in which the electronic device is located, thereby improving accuracy of brightness of a display unit.

Although the disclosure has been disclosed above with the embodiments, the embodiments are not intended to limit the disclosure. Any person skilled in the art can make some changes or modifications without departing from the spirit and scope of the disclosure. Therefore, the protection scope of the disclosure shall be defined by the claims.

What is claimed is:

1. An electronic device, comprising:

a display unit, comprising a brightness value;

a light sensor, configured to sense ambient light and generate a light intensity signal correspondingly; and a processor, coupled to the display unit and the light sensor, wherein the processor is configured to access a program instruction from a storage element, to perform the following steps:

receiving the light intensity signal continuously from the light sensor;

smoothing the light intensity signals received from the light sensor in a plurality of time frames, to generate a plurality of smoothing signals;

determining whether a difference generated by subtracting a previous smoothing signal from a target smoothing signal of the plurality of smoothing signals the is less than a first threshold or greater than a second threshold; and maintaining the brightness value of the display unit for a preset time period and then determining whether to adjust the brightness value when the difference is less than the first threshold or greater than the second threshold.

2. The electronic device according to claim 1, further comprising:

at least one orientation detector, configured to generate an orientation signal, wherein before performing the smoothing the light intensity signals step, the processor determines whether the electronic device is in a landscape mode or not according to the orientation signal, and the processor performs the smoothing the light intensity signals step when the electronic device is determined in the landscape mode.

3. The electronic device according to claim 1, wherein the performing a smoothing the light intensity signals step by the processor comprises smoothing the light intensity signals received from the light sensor in the time frames by Laplace smoothing, exponential smoothing, kernel smoothing, moving average, Ramer-Douglas-Peucker algorithm, smoothing spline, a Butterworth filter, a Kalman filter, a Chebyshev filter, an elliptic filter, a Kolmogorov-Zurbenko (K-Z) filter, a Savizky-Golay (S-G) filter or a low-pass filter.

4. The electronic device according to claim 1, wherein the preset time period is a first preset time period or a second preset time period, when the difference is less than the first threshold, the processor maintains the brightness value of the display unit for the first preset time period, or when the difference is greater than the second threshold, the processor maintains the brightness value of the display unit for the second preset time period.

5. The electronic device according to claim 4, wherein the processor is further configured to perform the following steps:

determining whether the smoothing signal received at a last time point of the first preset time period is greater than the target smoothing signal;

continuously maintaining the brightness value of the display unit when the smoothing signal received at the last time point of the first preset time period is greater than the target smoothing signal; and adjusting the brightness value of the display unit according to the smoothing signal received at the last time point when the smoothing signal received at the last time point of the first preset time period is less than or equal to the target smoothing signal.

6. The electronic device according to claim 4, wherein the processor is further configured to perform the following steps:

determining whether the smoothing signal received at a last time point of the second preset time period is less than the target smoothing signal;

continuously maintaining the brightness value of the display unit when the smoothing signal received at the last time point of the second preset time period is less than the target smoothing signal; and adjusting the brightness value of the display unit according to the smoothing signal received at the last time point when the smoothing signal received at the last time point is greater than or equal to the target smoothing signal.

7. The electronic device according to claim 1, wherein the first threshold and the second threshold are stored in the storage element.

8. The electronic device according to claim 1, wherein when the difference is not less than the first threshold or the difference is not greater than the second threshold, the processor adjusts the brightness value of the display unit according to the target smoothing signal.

* * * * *